US005655493A

United States Patent [19]

Enright et al.

[11] Patent Number: 5,655,493

[45] Date of Patent: Aug. 12, 1997

[54] EXHAUST VALVE FOR INTERNAL COMBUSTION ENGINE

[75] Inventors: Bernard F. Enright, Wauwatosa; David D. Lange, Milwaukee, both of Wis.

[73] Assignee: Dresser Industries, Inc., Dallas, Tex.

[21] Appl. No.: 587,422

[22] Filed: Jan. 16, 1996

[51] Int. Cl.[6] ..... F01L 3/04

[52] U.S. Cl. ..... 123/188.3; 123/188.9; 123/188.11

[58] Field of Search ..... 123/186.14, 188.3, 123/188.9, 188.11

[56] References Cited

U.S. PATENT DOCUMENTS

| | | | |
|---|---|---|---|
| 2,403,260 | 7/1946 | Charles | 123/188.9 |
| 3,809,046 | 5/1974 | Kammeraad | 123/188.9 |
| 4,200,066 | 4/1980 | Berchtold | 123/188.9 |
| 4,706,967 | 11/1987 | Ochsner | 123/188.9 |
| 4,798,181 | 1/1989 | Beer et al. | 123/188.9 |
| 5,295,461 | 3/1994 | Rao et al. | 123/188.3 |
| 5,507,257 | 4/1996 | Sakai et al. | 123/188.9 |

FOREIGN PATENT DOCUMENTS

| | | | |
|---|---|---|---|
| 1148812 | 5/1963 | Germany | 123/188.9 |
| 3205676 | 9/1982 | Germany | 123/188.9 |

OTHER PUBLICATIONS

TRW Handbook for Internal Combustion Engine, TRW Inc., 1987.

*Primary Examiner*—Erick R. Solis

*Attorney, Agent, or Firm*—Andrus, Sceales, Starke & Sawall

[57] ABSTRACT

A low-friction, extended-life exhaust valve has a coating on the valve stem that is protected from hot exhaust gases. The valve stem slides axially in a valve guide pressed into the cylinder head, and the coating on the valve stem is receded away from the end of the valve guide exposed to the hot exhaust gases passing through the exhaust port. Protecting the coating from the hot exhaust gases allows the use of coatings that cannot normally withstand the harsh environment to which the exhaust valve is exposed. The preferred coating is a molybdenum oxide coating, which not only retains lubricating oil because of its porous nature, but also has solid lubricity which is useful in case of hydrostatic breakdown of the lubricant between engine cycles. It is preferred that the non-coated portion of the valve stem, which is located towards the end of the valve guide where the hot exhaust gases are exposed, be recessed so that the bore of the valve guide contacts only the coated portion of the valve stem, thereby further reducing wear. Other embodiments of the invention involve various coatings and configurations for the valve guide as well as the valve stem.

18 Claims, 2 Drawing Sheets

EXHAUST VALVE FOR INTERNAL COMBUSTION ENGINE

FIELD OF THE INVENTION

The invention relates to valves for internal combustion engines, and in particular to a low-friction exhaust valve in which a solid coating on the valve stem is protected from hot exhaust gases.

BACKGROUND OF THE INVENTION

The invention is primarily directed to improving the durability of exhaust valves and valve guides in internal combustion engines, and is especially well suited for use in large industrial combustion engines fueled by natural gas. Large natural gas internal combustion engines are typically used to produce electrical power or propel ships, etc. Exhaust valves in these large engines are expected to last from 15,000 to 20,000 operating hours. Some manufacturers have gone to great lengths to provide sophisticated lubrication systems to improve longevity of exhaust valves.

Large internal combustion engines typically have exhaust valves coveting the exhaust ports which are opened to allow exhaust from the cylinders to escape through the exhaust ports into the engine exhaust manifold. Each exhaust port typically passes through the cylinder head. Each exhaust valve consists of a valve head which covers the exhaust port, and a perpendicular exhaust stem. The exhaust valve stem is supported radially within a valve guide that is either cast into or pressed into an opening in the cylinder head. There is normally only a small clearance between the bore of the valve guide and the valve stem (e.g., 3.2 to 4.3 thousandths of an inch clearance). The small clearance allows very little wobble, but is enough to maintain an oil film to keep the stem from sticking within the bore given manufacturing tolerances and thermal expansion which can occur.

To improve the durability of the interface between the valve stem and the valve guide bore, it is common to use a chrome or other hard, high temperature coating on the stem. Chrome coatings resist wear well. However, it is still desirable to maintain an oil film on the interface of the sliding surface between the valve stem and the valve guide to prevent metal-to-metal contact which tends to wear both metals. Chrome coatings for exhaust valves are not particularly well suited for maintaining a sufficient film of lubricating oil in reciprocating internal combustion engines. This is primarily due to the fact that exhaust valves are stationary almost three quarters of the time that the engine is operating. It is therefore difficult to maintain a hydrodynamic oil film because there is adequate time for the oil film to break down when the valve is not moving. Therefore, lubricating oil is not generally present at all contact areas between the valve stem and the bore in the valve guide when the valve starts to move.

Some coatings are more porous than chrome and help retain oil at the sliding surface. Nitriding is an example of a porous coating. However, even with porous coatings, the oil film can breakdown when the valve stem is not moving, thus allowing metal-to-metal contact at least occasionally. It is therefore desirable to use porous and even non-porous solid lubricant coatings. A solid lubricant coating is a coating having solid lubricity, i.e., the ability to reduce friction is inherent within the solid coating.

Molybdenum and molybdenum oxide are examples of solid lubricant coatings, however, neither can withstand the high temperatures of the harsh environment present in the exhaust port when the exhaust valve opens. The exhaust valve leads a particularly severe life because it is open at a time in the combustion cycle when exhaust gases are approximately 1100° F. or higher. In addition, the hot exhaust gases passing through the exhaust port pass the exhaust valve at a high velocity. In this environment, many coatings are not capable of surviving, including molybdenum oxide coatings as well as other solid lubricant coatings. Although many of these coatings can survive on intake valves, the environment on the exhaust valve is too harsh. These coatings tend to erode rapidly and flake into small particles where exposed to exhaust gas. The small particles can scratch the valve stem, and can possibly get stuck in the exhaust valve seat area which could hold the valve partially open and possibly burn the valve.

Exhaust valve and guide wear has become an important problem, and some manufacturers have even produced sophisticated forced lubrication systems including channels, etc. to extend the life of the exhaust valves and guides. Exhaust valve and guide wear problems are more prominent in natural gas engines because the fuel itself contains no lubricity. Gasoline and diesel fuel have more lubricity in the liquid states, and also form more particulate and ash that can act as a solid lubricant.

It can therefore be appreciated that it would be desirable to provide a cost effective way to reduce the wear of exhaust valves and valve guides, especially in large industrial natural gas internal combustion engines.

SUMMARY OF THE INVENTION

The invention provides a cost effective way to improve the life of exhaust valves and guides in large natural gas internal combustion engines by using a solid lubricant at the interface between the valve stem and the valve guide, and protecting the solid lubricant coating from the hot exhaust gases exiting the exhaust port in the cylinder head. The invention preferably uses a molybdenum oxide coating on the valve stem and recedes the coating from the end of the valve guide exposed to the hot exhaust gases passing through the exhaust port. Molybdenum oxide is the preferred coating not only because it is a solid lubricant, but also because it can be applied with sufficient porosity to retain liquid lubricant along the sliding surface between the valve stem and the valve guide.

To further improve the wearability of the exhaust valve and guide, it is preferred that the non-coated portion of the valve stem be recessed so that the valve guide contacts only the coated portion of the valve stem when the valve is opened and closed.

In the preferred embodiment, the invention is an internal combustion engine that includes a cylinder head having an exhaust port and a valve guide pressed into an opening in the cylinder head. The valve guide has an internal bore with one of its ends exposed to the hot exhaust gases passing through the exhaust port. The engine has an exhaust valve with a head sized to cover the exhaust port, and a stem slidably mounted in the bore of the valve guide so that the valve stem can be moved axially within the valve guide to open and close the valve head over the exhaust port. The valve stem has a coated portion, preferably coated with molybdenum oxide, the coated portion is supported laterally by the bore of the valve guide. The coated portion is receded from the end of the valve guide exposed to the hot exhaust gases passing through the exhaust port when the valve is open. In a large natural gas engine, the coating is preferably receded so that it is no closer than approximately 4 to 6 millimeters from the end of the valve guide exposed to the hot exhaust gases when the valve is open.

To further improve the wearability of the exhaust valve and the valve guide, it is preferred that the non-coated portion of the valve stem be recessed so that the bore of the valve guide contacts only the coated portion of the valve stem when the valve is opened and closed. In a large natural gas engine, it is preferred that the recess have a depth between 0.002 and 0.006 of an inch with respect to the radius of the valve stem. Limiting the recess depth protects the coating from the exhaust gas.

Alternatively, it may be desirable to provide a recess in the bore of the valve guide at the end of the valve guide that is exposed to the hot exhaust gases passing through the exhaust port. This is another configuration in which the bore of the valve guide contacts only the coated portion of the valve stem when the valve is opened and closed.

In another alternative embodiment of the invention, it may be desirable to provide a coating on the bore surface of the valve guide in addition to or instead of the coating on the valve stem. In this embodiment of the invention, the coating on the bore surface should be receded from the end of the valve guide exposed to the hot exhaust gases to protect the coating from the hot temperatures. In this embodiment, it may be desirable to recess the non-coated portion of the bore located towards the end of the valve guide exposed to the hot exhaust gases, or alternatively it may be desirable to recess the part of the valve stem corresponding to the non-coated part of the valve guide bore, thus allowing the valve guide stem to contact only the coated portion of the bore of the valve guide when the valve moves.

The primary object of this invention is to improve the wearability of exhaust valves and valve guides in internal combustion engines, especially large industrial natural gas internal combustion engines in which the exhaust valves and guides are expected to last 15,000 to 20,000 hours. However, the invention is not limited to use on engine exhaust valves and guides, but can also be used on other reciprocating shafts in high temperature environments such as compressors, etc.

Other advantages and features of the invention should be apparent to those skilled in the art upon reviewing the following drawings and description thereof.

DETAILED DESCRIPTION OF THE DRAWINGS

Figure 1:
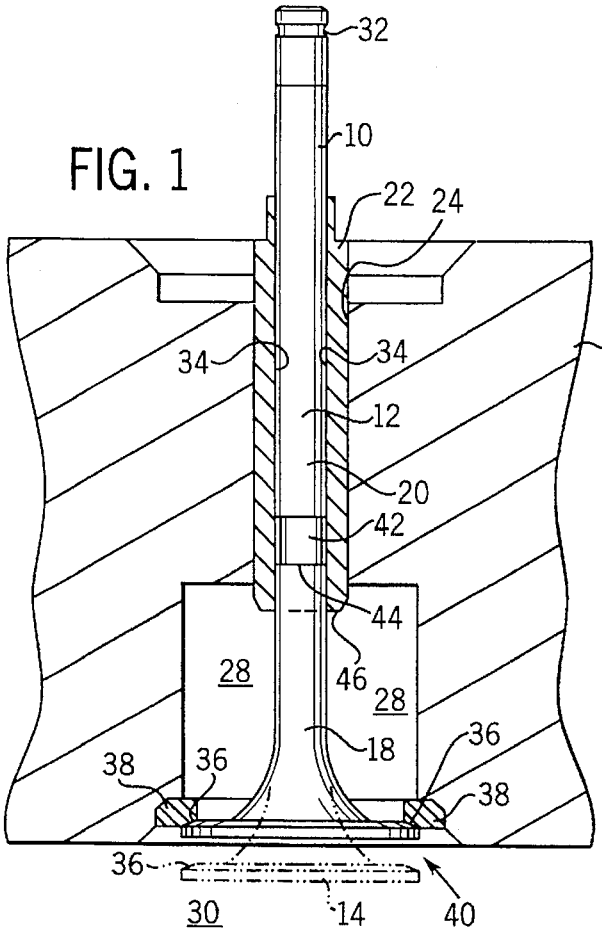
FIG. 1 is a side elevational view depicting an exhaust valve installed in an internal combustion engine in accordance with the invention.
Figure 2:
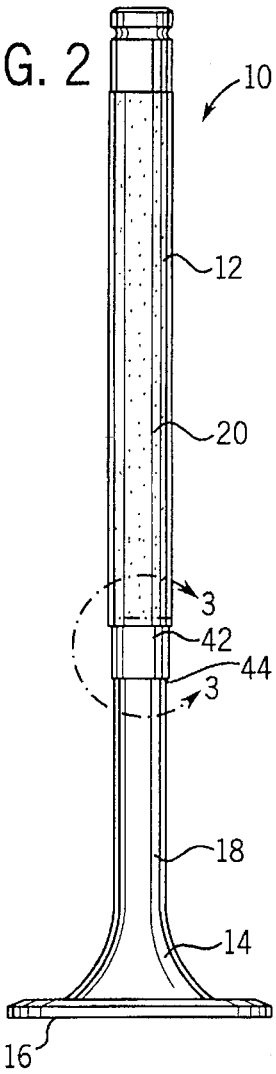
FIG. 2 is a side elevational view of the exhaust valve shown in FIG. 1.
Figure 3:
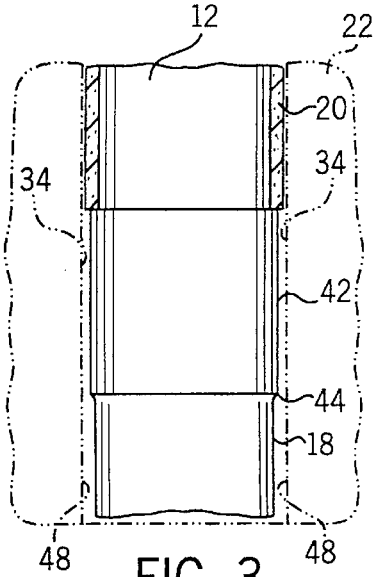
FIG. 3 is a detailed view of the area depicted by lines 3—3 in FIG. 2.

FIGS. 1 through 3 illustrate a low-friction, extended-life exhaust valve 10 in accordance with a first embodiment of the invention. The exhaust valve 10 is particularly well suited for use in large, natural gas internal combustion engines and this is the preferred application for the invention.

The valve 10 includes a stem 12 and an integral valve head 14. The valve head 14 has a front circular face 16, which typically can have a diameter of about 52 millimeters in a large natural gas engine. The head has a shank 18 extending perpendicularly rearward from the front face 16. The head 14 is preferably made of stainless steel. A typical diameter for most of the length of the shank 18 is about 10.6 millimeters in a large natural gas engine. The stem 12 is preferably made of 4140 steel, and typically has a diameter of about 11 millimeters in the preferred application if one includes the coating depicted by reference numeral 20 when measuring the diameter of the stem 12. The stem 12 is welded to the shank 18 to form an integral exhaust valve 10.

Referring in particular to FIG. 1, the exhaust valve 10 is slidably mounted within a valve guide 22. The valve guide 22 is typically made of cast iron, but could also be made out of powdered metal. Powdered metal guides tend to have some amount of solid lubricity. The valve guide 22 is press fit into an opening 24 in cylinder head 26 for the internal combustion engine. The cylinder head 26 has an exhaust port 28 from an engine combustion chamber or cylinder in the area indicated by reference numeral 30. The valve 10 is opened and closed by actuating the valve 10 in the part of the valve 10 by chamfer 32, thus displacing the valve 10 in the direction along the axis of the stem 12. The valve guide 22 has an internal bore 34 that laterally supports the exhaust valve stem 12. The clearance between the bore surface 34 and the valve stem 12 is preferably 3.2 to 4.3 thousandths of an inch, which is sufficient to maintain an oil film given manufacturing tolerances and thermal expansion, yet tight enough to allow little wobble.

When the valve 10 is in the closed position, the backside 36 of the head 14 mates against a valve head seat 38 to prevent hot exhaust gases in the combustion chamber 30 from flowing through the exhaust port 28. When the valve 10 is opened, hot exhaust gases in the chamber 30 pass into and through the exhaust port 28 as depicted by arrow 40. By way of example, a fully opened valve 10 is displaced about 16 millimeters from a fully closed valve 10 in the preferred application.

In accordance with the invention, the stem 12 of the valve 10 has a coated portion 20 and a non-coated portion 42. Referring now in particular to FIG. 3, the valve stem 12 may include a sharp corner or carbon scraper 44 at or near the junction between the valve stem 12 and the shank 18 of the valve head 14. When the valve 10 is in the closed position, the carbon scraper 44 is located within the bore 34 of the valve guide 22. The end 46 of the valve guide 22, and in particular the region 48 of the bore 34 of the valve guide 22, is exposed to hot exhaust gases passing through the exhaust port 28. Carbon or other particulates can therefore accumulate within the internal bore 34 in the region 48 in front of the carbon scraper 44 when the valve is closed due to residual exhaust gases or other combustion products in the exhaust port 28. The sharp edge of the carbon scraper 44 scrapes away excessive build-up in region 48 as the valve 10 opens.

As shown best in FIG. 3, the non-coated portion 42 of the valve stem 12 extends completely between the coated portion 20 of the valve stem 12 and the carbon scraper 44. By way of example, the length of the non-coated portion 42 along the axis of the stem 12 is approximately 10–11 millimeters in the preferred application. Receding the coating 20 from the end 46 of the valve guide 22 when the valve 10 is open protects the coating 20 from hot exhaust gases passing through the exhaust port 28. The exhaust gases in the exhaust port 28 in a large industrial natural gas combustion engine are typically about 1050° F. to 1075° F. and can exceed 1100° F. However, the preferred coating 20, molybdenum oxide, cannot repeatedly withstand temperatures over 600° F. Receding the coating 20 away from the hot exhaust gases protects the coating from the hot exhaust gases and enables the use of low temperature coatings such as molybdenum oxide, which would otherwise tend to flake and deteriorate due to the high temperatures of the hot exhaust gases.

The molybdenum oxide coating 20 is preferably 0.008 of an inch thick in the preferred application. The molybdenum oxide coating 20 not only has the advantage that it can be applied with sufficient porosity to retain lubricating oil, but also has the advantage of solid lubricity. Thus, the molybdenum oxide coating provides roughly a 4/1 benefit (i.e. ¼ the wear rate) over porous, non-solid lubricant coatings such as nitriding.

The non-coated portion 42 of the valve stem 12 is also preferably slightly recessed so that the bore 34 of the valve guide 22 contacts only the coated portion 20 of the valve stem 12 when the valve 10 is opened and closed. The depth of the recess in the non-coated portion 42 of valve stem 12 is preferably between 0.002 and 0.006 of an inch with respect to the radius of the stem 12.

One way of manufacturing the valve stem 12 disclosed in FIGS. 1 through 3 is to grind a typical non-coated valve down approximately 0.008 of an inch on the radius of the stem 12 to create a trough for the coating 20. The coating 20 can then be applied by placing the valve 12 on a rotating fixture and applying the coating 20 with a plasma spray gun. The non-coated portion 42 can then be ground down to remove any overspray of the coating 20, and also create the 0.002 to 0.006 of an inch recess.

Figure 4:
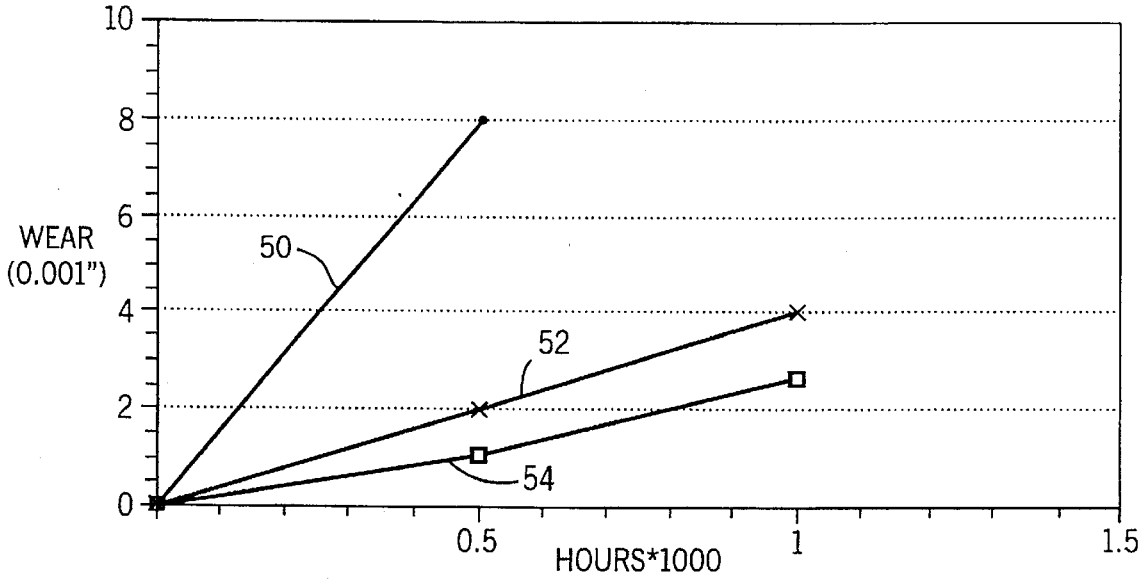
FIG. 4 is a graph illustrating the improved wearability over the prior art of the embodiment of the invention shown in FIGS. 1 through 3.

FIG. 4 shows accelerated endurance test results illustrating the effect the invention has on improving the wearability of exhaust valves over time. Curve 50 indicates that a prior art valve having a chrome plated stem encountered 0.008 of an inch wear after 500 hours of operation under test conditions. Curve 52 represents a valve stem having a receded molybdenum oxide coating 20. Curve 52 indicates only 0.002 of an inch wear after 500 hours and 0.004 of an inch wear after 1,000 hours, which is a significant improvement. Note that curve 52 represents a valve in which the non-coated portion 44 is not recessed. It can thus be appreciated that the solid lubricity of the molybdenum oxide coating improves the wearability of the valve significantly compared to the conventional chrome plated valve. Curve 54 represents a valve stem having a receded molybdenum oxide coating 20 in which the non-coated portion 44 of the valve stem 12 is recessed. Recessing the non-coated portion 44 between the coated portion 20 and the carbon scraper 44 on the valve stem 12 further increases the wearability as illustrated by curve 54 showing, under the test conditions, a 0.001 inch wear after 500 hours of operation, and a 0.0024 inch wear after 1,000 hours of operation. Without recessing the non-coated portion 44 on the valve stem 12, the wear rate tends to be higher.

Figure 5:
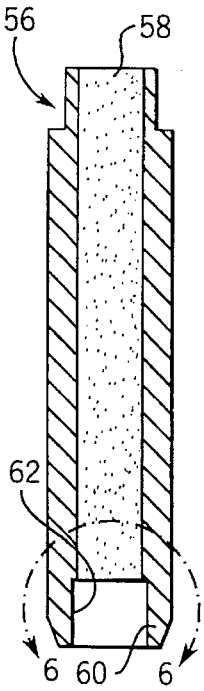
FIG. 5 depicts a valve guide in accordance with another embodiment of the invention.
Figure 6:
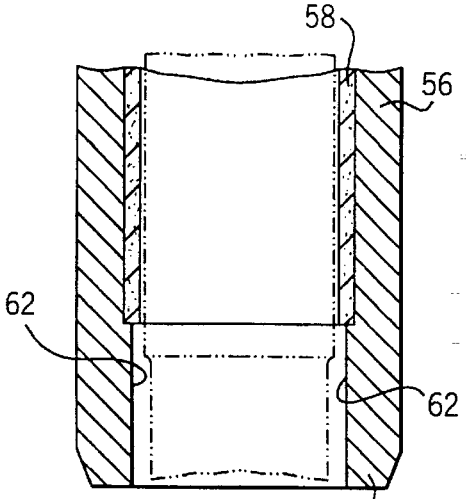
FIG. 6 is a detailed view of the area depicted by lines 6—6 in FIG. 5.

FIGS. 5 and 6 illustrate another embodiment of the invention in which a valve guide 56 is provided with a coating 58 within its internal bore. The coating 58 is receded from the end 60 of the guide 56 that is exposed to the hot exhaust gases in the exhaust port 28. The bore of the valve guide 56 thus includes a coated portion 58 and a non-coated portion 62. The non-coated portion 62 is preferably recessed so that the valve stem will contact only the coated portion 58 of the internal bore of the valve guide 56 when the valve stem moves. The coating 58 could be applied to the internal bore of the valve guide 56 by dipping. In the embodiment shown in FIGS. 5 and 6, it is not necessary to provide a coating on the valve stem, nor is it necessary to provide a non-coated recessed portion in the valve stem. Therefore, a conventional non-coated exhaust valve can be used with the coated valve guide 56 shown in FIGS. 5 and 6, and the system should provide the advantages of the invention as described with respect to the embodiment of the invention shown in FIGS. 1 through 3.

Other configurations in accordance with the invention are also possible. One such configuration would be similar to the embodiment shown in FIGS. 1 through 3 where the coating 20 on the valve stem 12 is receded but instead of recessing the non-coated portion 42 on the valve stem 12 between the coated portion 20 and the carbon scraper 44, the bore 34 of the valve guide 22 by the end 46 near the hot exhaust gases could be recessed similar to that shown by reference numeral 62 in FIG. 5. Likewise, in the embodiment shown in FIGS. 5 and 6, it may be desirable to leave the non-coated portion 62 of the valve guide bore flush with the coated portion 58 of the bore, and recess the corresponding portion on the valve stem 12 similar to that shown by reference numeral 42 in FIGS. 1 through 3.

Other modifications, alternatives and equivalents may be apparent to those skilled in the art. Such modifications, alternatives or equivalents should be considered to be within the scope of the following claims.

We claim:

1. An internal combustion engine comprising:

a cylinder head having an exhaust port from an engine cylinder;

a valve guide pressed into an opening in the cylinder head, the valve guide having an internal bore with an end exposed to hot exhaust gases passing through the exhaust port; and an exhaust valve having a head sized to cover the exhaust port and a stem slidably mounted in the bore of the valve guide so that the valve stem can be moved axially within the bore of the guide to open and close the valve head over the exhaust port;

wherein the valve stem has a coated portion that is supported laterally by the bore of the valve guide, the coated portion of the valve stem being coated with a coating not capable of surviving prolonged exposure to the hot exhaust gases passing through the exhaust port, and the coated portion being receded from the end of the guide exposed to the hot exhaust gases passing through the exhaust port when the valve is open to protect the coating from the hot exhaust gases.

2. An internal combustion engine as recited in claim 1 wherein the coated portion of the valve stem is coated with a layer of molybdenum oxide.

3. An internal combustion engine as recited in claim 1 wherein the low temperature coating is a solid lubricant having sufficient porosity to retain a liquid lubricant.

4. An internal combustion engine as recited in claim 1 wherein the valve stem has a recessed non-coated portion adjacent the receded coated portion in the direction of the valve head, the recessed portion extending along the valve stem so that the bore of the valve guide contacts only the coated portion of the valve stem when the valve is opened and closed.

5. An internal combustion engine as recited in claim 4 wherein the valve stem includes a carbon scraper and the recessed portion of the valve stem extends completely between the coated portion of the stem and the carbon scraper.

6. An internal combustion engine as recited in claim 4 wherein the depth of the recess is between 0.002 of an inch and 0.006 of an inch with respect to the radius of the stem.

7. An internal combustion engine as recited in claim 4 wherein the length of the recessed non-coated portion along the axis of the stem is approximately 10 to 11 millimeters.

8. An internal combustion engine as recited in claim 1 wherein the coated portion is no closer than approximately 4 to 6 millimeters from the end of the guide exposed to the hot exhaust gases passing through the exhaust port when the valve is open.

9. An internal combustion engine as recited in claim 1 wherein the engine is fueled with natural gas.

10. An internal combustion engine as recited in claim 1 wherein the bore of the valve guide has a recessed portion adjacent the end of the valve guide exposed to the hot exhaust gases so that the bore of the valve guide contacts only the coated portion of the valve stem when the valve is opened and closed.

11. In an internal combustion engine having a cylinder head through which an exhaust port passes and an opening into which a valve guide is pressed, the valve guide having a bore with an end exposed to hot exhaust gases passing through the exhaust port, an improved exhaust valve of the type having a head sized to cover the exhaust port and a stem adapted to be slidably mounted in the bore of the valve guide so that the valve stem can be moved axially within the bore to open and close the valve head over the exhaust port, the improved exhaust valve comprising:

a valve stem having a coated portion that is supported laterally by the bore of the valve guide, the coated portion of the valve stem being coated with a coating not capable of surviving prolonged exposure to the hot exhaust gases passing through the exhaust port, the coated portion being receded from the end of the guide exposed to the hot exhaust gases passing through the exhaust port when the valve is open to protect the coating from the hot exhaust gases.

12. The exhaust valve recited in claim 11 wherein the coated portion of the valve stem is coated with a layer of molybdenum oxide.

13. The exhaust valve recited in claim 12 wherein the low temperature coating is a solid lubricant having sufficient porosity to retain a liquid lubricant.

14. The exhaust valve recited in claim 11 wherein the valve stem has a recessed non-coated portion adjacent the receded coated portion in the direction of the valve head, the recessed portion extending along the valve stem so that the bore of the valve guide contacts only the coated portion of the valve stem when the valve is opened and closed.

15. The exhaust valve recited in claim 14 wherein the valve stem includes a carbon scraper and the recessed portion extends completely between the coated portion of a stem and the carbon scraper.

16. The exhaust valve recited in claim 14 wherein the recessed portion of the stem is recessed to a depth between 0.002 and 0.006 with respect to the radius of the stem.

17. The exhaust valve recited in claim 14 wherein the length of the recessed non-coated portion along the axis of the stem is approximately 10 to 11 millimeters.

18. The exhaust valve recited in claim 11 wherein the coated portion is no closer than approximately 4 to 6 millimeters from the end of the guide exposed to the hot exhaust gases passing through the exhaust port when the exhaust valve is open.

* * * * *